United States Patent [19]

Hupp et al.

[11] 4,034,644

[45] July 12, 1977

[54] FIREARM AND MAGAZINE CONSTRUCTION

[75] Inventors: Gerhard Hupp, Oberndorf (Neckar); Helmut Mäder, Schramberg, both of Germany

[73] Assignee: Industriewerke Karlsruhe-Augsburg Aktiengesellschaft, Germany

[21] Appl. No.: 584,292

[22] Filed: June 6, 1975

[30] Foreign Application Priority Data

June 10, 1974 Germany ..... 2427974

[51] Int. Cl.[2] ..... F41C 25/06

[52] U.S. Cl. ..... 89/33 BA; 42/49 R; 42/87

[58] Field of Search ..... 42/6, 7, 17, 49 R; 89/33 B, 33 BA, 34

[56] References Cited

U.S. PATENT DOCUMENTS

| | | | |
|---|---|---|---|
| 1,285,263 | 11/1918 | Lohne | 42/49 R |
| 1,342,358 | 1/1920 | Storle | 89/33 BA |
| 3,088,378 | 5/1963 | Boudreau | 42/6 |

*Primary Examiner*—Stephen C. Bentley
*Attorney, Agent, or Firm*—McGlew and Tuttle

[57] ABSTRACT

A firearm comprises a stock having a barrel mounted thereon for the magazine chamber associated with the stock which has a passage for the cartridges extending between an interior chamber of the magazine and the cartridge chamber associated with the barrel. The magazine is constructed to contain a plurality of cartridges therein for example in an annular arrangement around a rotatable cartridge transport star. The cartridges are arranged in parallel relationship to the magazine chamber and they are moved by the transport mechanism during the firing operation successively into association with the cartridge chamber of the barrel. The magazine is also provided with an opening which provides means for mounting a cartridge clip or carrier so that cartridges may be loaded into the magazine through the opening which is communicable with the chamber in the magazine for the cartridges. In one embodiment, the communication is established by rotating an interior holder arranged within the magazine so as to shift a tangentially extending passage portion which extends from the cartridge chamber in the magazine to the cartridge chamber associated with the barrel into a position in which the passage is aligned with the loading opening rather than with the cartridge chamber of the barrel. In another embodiment, the loading opening communicates upon insertion of the clip directly with an annular cartridge space in the magazine on one side thereof after a cover closing the opening is positioned in a location to block the further upfeed of the cartridges into alignment with the barrel cartridge chamber.

9 Claims, 5 Drawing Figures

50
14
11
13
12
9
8b
10a
11
10
16
15
16

8b
13
12
10a
9
11
10
15
16

FIREARM AND MAGAZINE CONSTRUCTION

FIELD AND BACKGROUND OF THE INVENTION

This invention relates in general to the construction of firearms and to magazines therefor and, in particular, to a new and useful firearm having a magazine which includes an interior chamber for cartridges and has means for transporting the cartridges out of the magazine chamber into alignment with the cartridge chamber of the gun and a magazine clip loading opening which is communicable with the cartridge chamber in the magazine for loading the cartridge directly from a clip into the cartridge chamber of the magazine.

DESCRIPTION OF THE PRIOR ART

A very important requirement for a modern firearm is that it be capable of accommodating a very large amount of ammunition and with means for rapidly loading this ammunition into the firearm. To meet such a requirement, it has been known for a long time to use magazines in which cartridges are stored and which are connectable to and removable from the firearm by means of a simple locking mechanism. Such a magazine, for example, may take the form of a receptacle having a rectangular cross-section or a box-type magazine, or it may comprise a rotationally symmetrical drum-type magazine. Also known are curved variants of the box-type magazine. Usually, anywhere from 10 to 30 cartridges can be stored in such magazines. The box-type as well as the drum magazines have the drawbacks that they project from the contour of the firearm to a considerable extent and, thereby, make the weapon bulky and also they unfavorably affect the position of the center of gravity of the firearm, particularly at the discharge. In an attempt to overcome such shortcomings, there has been proposed an ammunition supply receptacle having a substantially cylindrical shape and provided with a fixed transfer spiral for feeding the ammunition stored in the receptacle into the cartridge chamber at the rear end of the barrel. The known ammunition supply receptacle is adapted to be inserted coaxially of the barrel into a recess provided in the housing of the firearm. Upon actuation of a locking mechanism, the empty supply receptacle can be removed from the firearm and replaced by a new receptacle which is filled with ammunition. Even though dut to its coaxial position relative the barrel, this known supply receptacle does not make the firearm too bulky but its geometry does not result in a satisfactory arrangement due to the weight of the receptacle and also to its location at the righthand side or the lefthand side of the barrel, the position of the center of gravity is affected at least at the discharge of the barrel, and the weapon shows a strong tendency toward tilting.

While some of the above drawbacks could perhaps be overcome by a displacement of the masses of the firearm or by adequate training of the user of the firearm, so that the unbalance can be tolerated, there is still the shortcoming, particularly with the use of caseless ammunition, that the loading time and resupplying of cartridges to the weapon is too great.

SUMMARY OF THE INVENTION

The present invention provides a firearm and a magazine construction therefor which is capable of being loaded with ammunition by the user rapidly and simply and without interfering to any great extent with the readiness condition of the weapon. The construction of the invention makes it possible to provide a weapon which may be used on the combat field under any imaginable conditions of weather such as heat, cold, mud, dampness, sand, etc., and in a construction which is compatible to the use of other desirable features, such as the securing of the weapon.

In accordance with the invention, the supply receptacle or cartridge holder or magazine forms an integral part of the weapon and is completely enclosed by the housing of the firearm and is adapted to be brought from a first position in which the firearm is secured and can be reloaded easily into a second position in which the ammunition stored in the supply receptacle can be fed into the cartridge chamber associated with the firearm barrel.

In accordance with one feature of the invention, the magazine is formed as a magazine chamber in the gun housing which includes a drum-like magazine portion having a tangential passage extending from the drum-like portion in a ready position to the cartridge chamber. A cartridge transport mechanism associated with the drum-like chamber is, therefore, ready to feed the cartridges rapidly through the passage to the barrel cartridge chamber. The drum-like chamber may be rotated, however, to position the tangential passage so that it aligns with a cartridge loading opening in a position to be located directly below a magazine clip which may be mounted on the opening or positioned in alignment with the passage for the transfer of new cartridges from the clip directly into the magazine. During the reloading of the supply receptacle, the passage portion of the magazine cartridge chamber is positioned so that it extends obliquely below the loading opening for the cartridges. The opening is advantageously closable by a lid which may be biased into a closed position, for example, and sprung open when the magazine clip is aligned with the opening. The loading passage may be easily shifted so that it becomes a feeding passage for feeding the cartridges from the cartridge chamber in the magazine to the cartridge chamber of the weapon.

The inventive arrangement works very well with a clip or package of ammunition which, for example, may contain several cartridges in an easily openable casing which may be deformed or squeezed in order to force the cartridges into the magazine chamber. The casing may be of a material which may be easly broken itself or it may be provided with an opening line or slide fastener, etc.

By making the magazine an integral part of the weapon formed within the housing of the weapon, it is possible to provide a weapon which is less bulky and to provide a construction in which the actuating members for loading and transferring the ammunition into the cartridge chamber are completely enclosed. With such a construction, except for the muzzle, the weapon is protected to the highest extent against any unfavorable influence of the outside.

The inventive arrangement also makes it possible to reload the weapon on the combat field without any difficulty. The rifleman advantageously carries a plurality of box-shape and plastic ammunition receptacles on the combat field and by a simple manipulation, he is able to open the plastic cases and immediately insert the ammunition into the magazine by merely opening a cover in the side of the gun housing. The cartridge may be squeezed out of the casing containing them and positioned directly into the magazine chamber. The construction advantageously includes a lock against a possible backdrop of the ammunition to prevent jamming, for example, or an irregular positioning of the cartridge.

The inventive construction preferably includes a magazine formation directly in the housing of the weapon and in alignment with the gun barrel and preferably symmetrically aligned therewith. This produces many desirable effects. The particular construction makes it possible to maintain a relatively large amount of ammunition directly in the supply receptacle of the magazine. A preliminary condition for this is a sufficiently high degree of safety during the manipulation and protection against an unintentional actuation of the trigger. This condition is met, with the invention, in a simple manner due to the provision of one embodiment wherein the feeding tube for feeding the cartridges from the magazine chamber to the cartridge chamber is positioned in a loading condition such that it aligns with the loading opening rather than with the cartridge chamber. The change from one position to the other may be effected very rapidly and it is advantageously associated with mechanism for securing the trigger against actuation when it is positioned in a loading orientation.

Accordingly, it is an object of the invention to provide an improved firearm with a magazine directly formed in the housing and aligned with the gun barrel and preferably symmetrically therewith, and which includes a chamber for cartridges in the magazine with transport means associated with the cartridges for feeding the cartridges from the chamber to the cartridge chamber associated with the gun barrel, and which also includes a loading opening which communicates with the cartridge chamber in the magazine and which advantageously provides a safety against the trigger operation when loading is being effected.

A further object of the invention is to provide a magazine construction which includes an interior drum-like chamber which is rotatable within a magazine housing which is preferably formed within the housing of the gun and which includes a passage connecting into the drum-like chamber for the passage of cartridges from the drum-like chamber successively into alignment with the cartridge chamber and which may be alternatively positioned to align with a loading opening so that the cartridges may be loaded through the passage into the chamber.

A further object of the invention is to provide a magazine construction which includes an annular magazine cartridge chamber having a rotatable transport means associated therewith for moving cartridges out of the chamber up into alignment with a gun barrel cartridge chamber and which includes a loading opening for mounting a loading clip having an inlet door which may be displaced for example to block further feeding of the cartridges and to align the opening with the magazine chamber for filling the chamber.

A further object of the invention is to provide a firearm and a cartridge chamber which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

DESCRIPTION OF THE PREFERRED EMBODIMENTS

Figure 1:
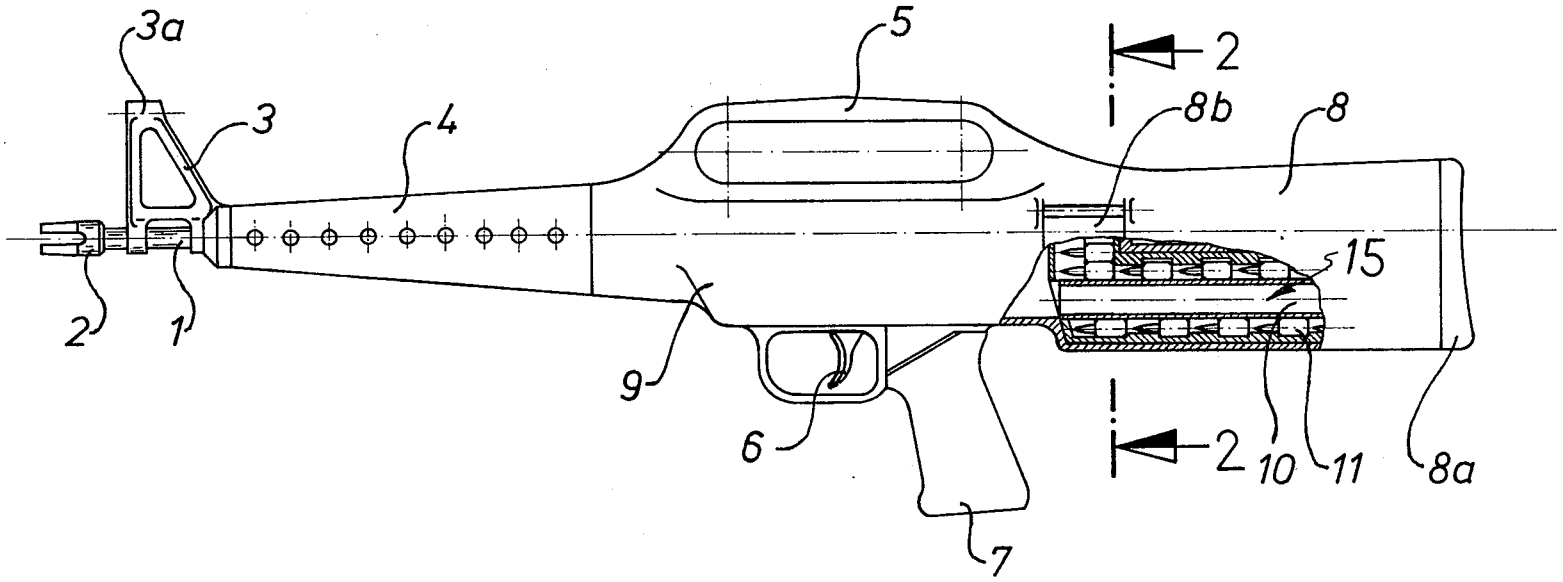
FIG. 1 is a side elevational view partly in section of a compact hand firearm constructed in accordance with the invention.
Figures 2, 3:
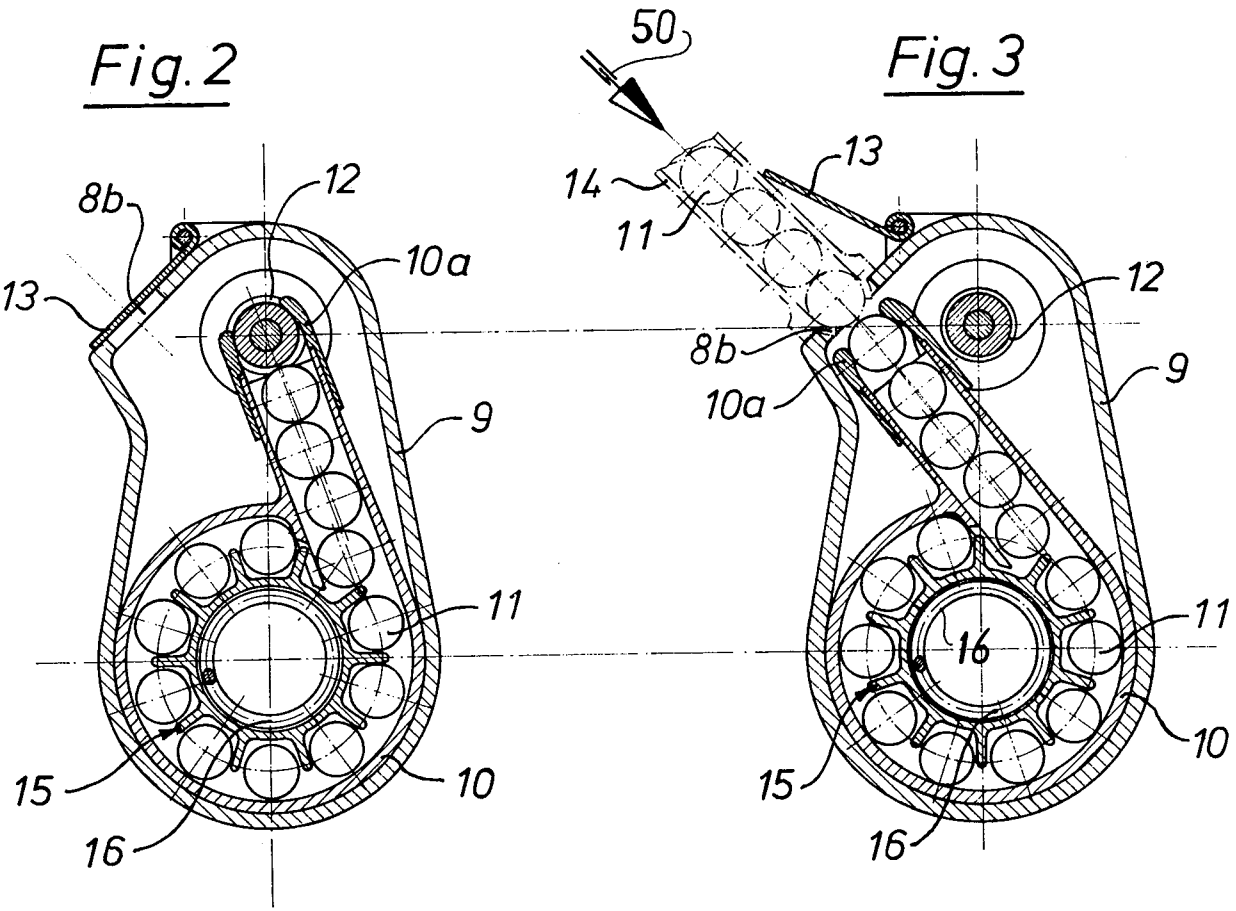
FIG. 2 is a section taken along the line 2—2 of FIG. 1.
FIG. 3 is a view similar to FIG. 2 showing the cartridge chamber in a loading position.

Referring to the drawings in particular, the invention embodied therein as shown in FIGS. 1 to 3, comprises a weapon which includes a gun barrel 1, having a muzzle flash hider 2 and provided with a bead carrier 3 having a bead 3*a* arranged in front of a hand guard 4. The rifle housing includes a handle portion 5 which is provided with a sight notch (not shown). A trigger mechanism 6 is located forwardly of a grip stock 7 and a butt portion 8 to the rear of the grip stock 7 is provided with an elastic butt plate 8*a*.

In accordance with the invention, the weapon includes a cartridge supply receptacle or magazine 10 which is formed symmetrically in respect to the gun barrel 1 and which is preferably usable with caseless ammunition or cartriges 11 which are fed by a cartridge transport means, generally designated 15, into alignment with a cartridge chamber 12 associated with the rear end of gun barrel 1.

In accordance with a feature of the invention, the magazine includes an outer wall portion 9 forming part of the gun housing and an inner drum-like supply receptacle 10 which is constructed to hold a plurality of cartridges 11 with their axes parallel to the axis of the gun barrel 1.

In the embodiments of FIGS. 1 to 3, the cartridge transport means comprises a star or rotatable feeding mechanism 15 which permits easy alignment and storage of the cartridges in an annular space within the supply receptacle part 10 and the feeding of the cartridges upwardly through a passage or chute 10*a* to the cartridge chamber. When the drum-like receptacle 10 is rotated to the position indicated in FIG. 3, the passage or chute 10*a* is aligned beneath a cartridge loading opening 8*b* which is defined on one side of the housing. The loading opening has a hinged lid 13 which may be opened to position an auxiliary receptacle or supply clip 14 or a plurality of new cartridges 11. With the chute 10*a* positioned as shown in FIG. 3, the cartridges may be transferred into chute 10*a* and into the supply receptacle 10, for example, by applying pressure in the direction of the arrow 50, shown in FIG. 3, such as by deforming the wall or casing of the receptacle 14 or by using a transfer mechanism (not shown). With chute 10*a* positioned as shown in FIG. 3, the weapon may be easily reloaded and in the preferred form, the rotation of the receptacle 10 to position chute 10*a* in the oblique position aligned beneath the opening 8*b* causes the setting of the firearm in a safety position or secured position. The auxiliary receptacle 14 is advantageously ripped open by hand on the side that faces the opening 8*b* and it may be held in this position or suitable means may be provided for securing it in this position on the housing until the cartridges are all transferred. To facilitate the opening of the auxiliary receptacle 14, it may be provided with tail lines, slide fasteners, etc. The individual cartridges 11 pass under the pressure of the subsequent cartridges into the zone of the transfer star 15 which provides for the feeding, alignment and storage of the cartridges in an annular space within the receptacle 10. In the construction illustrated, the introduction of the cartridges 11 causes rotation of the star 15 and a biasing of a torsion spring 16 connected to the star due to the rotation of star 15.

Figure 4:
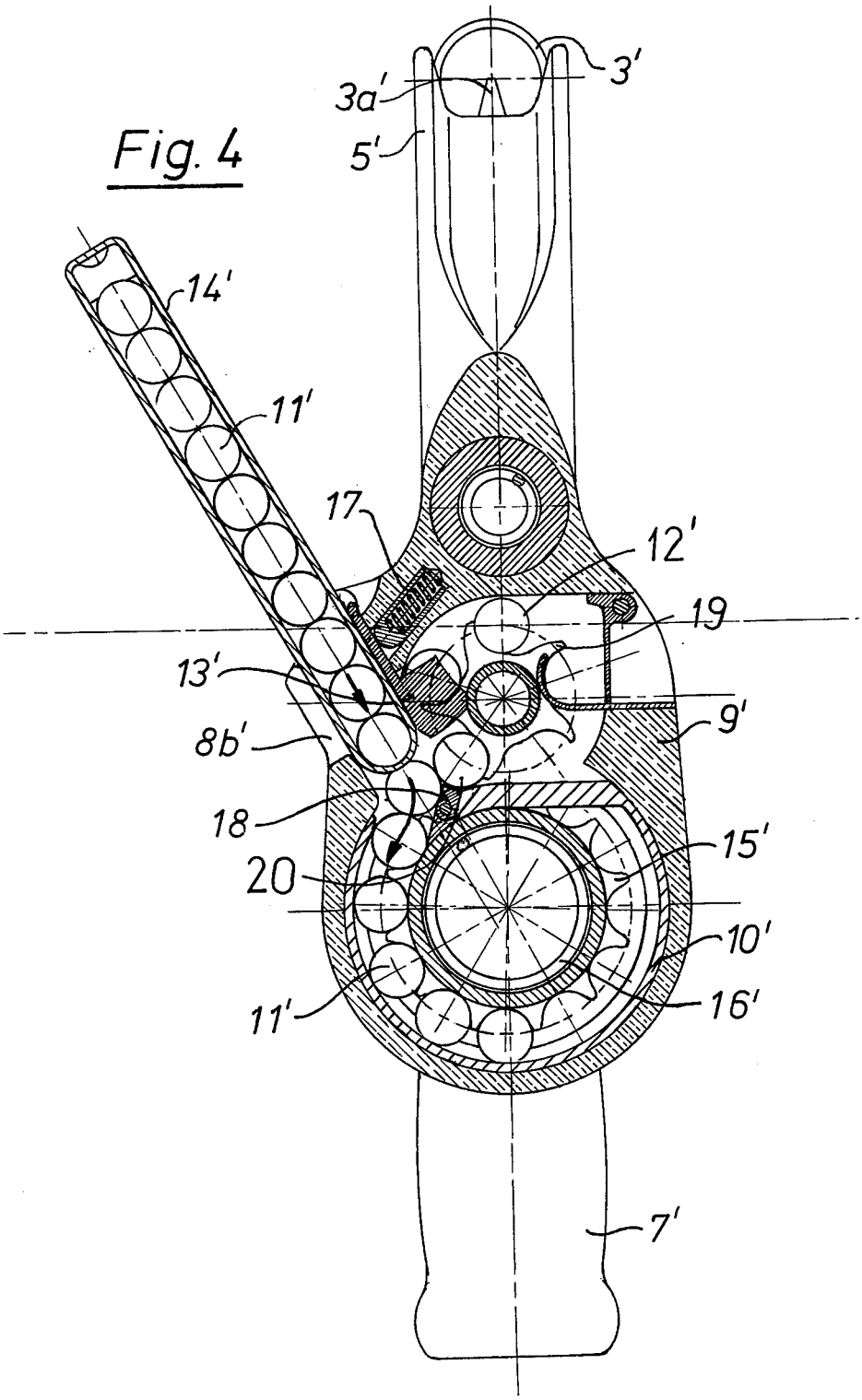
FIG. 4 is a vertical sectional view through the barrel and the magazine chamber of another embodiment of the firearm.
Figure 5:
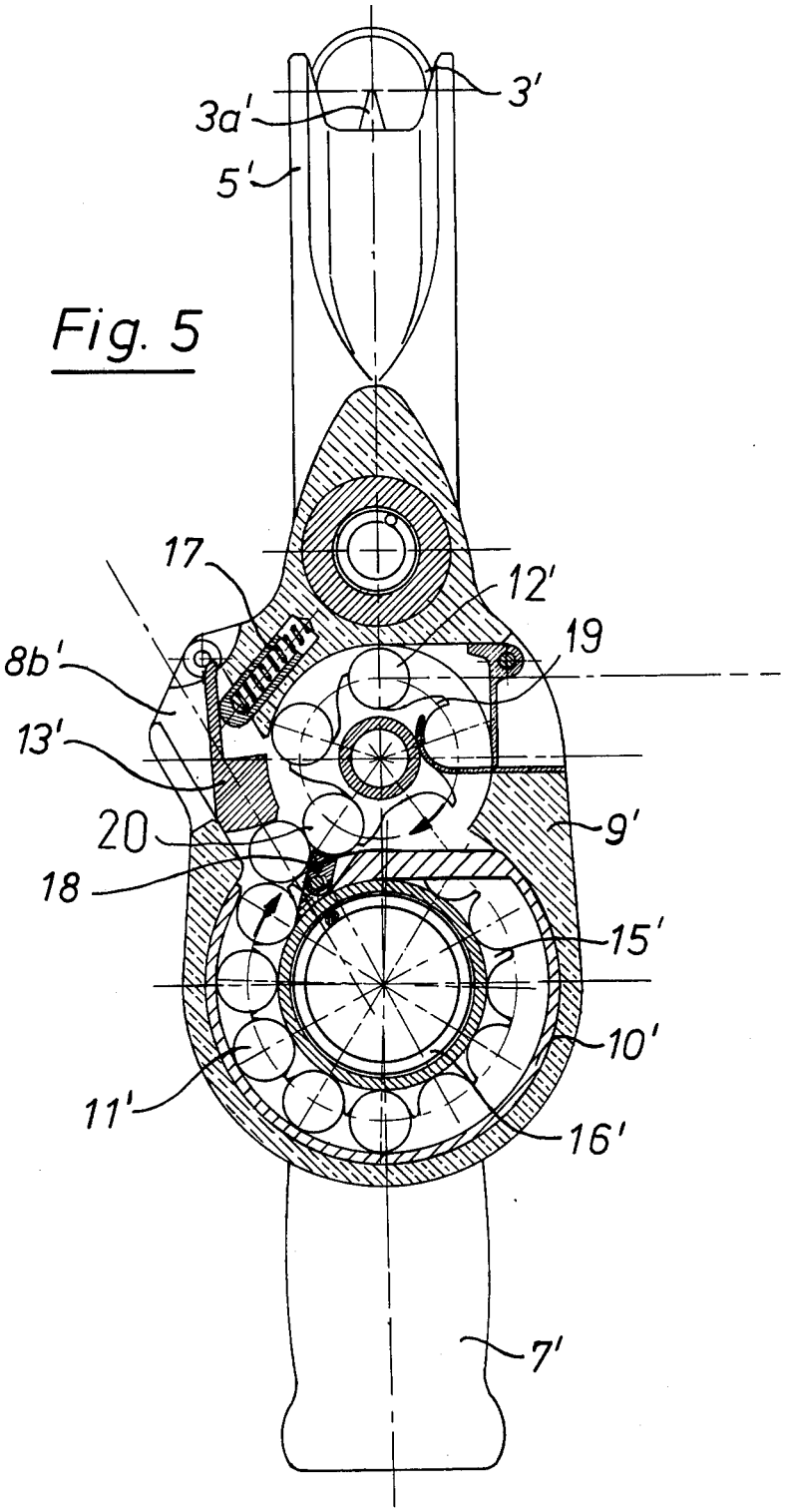
FIG. 5 is a section similar to FIG. 4 showing the parts in a firing position.

In the embodiment shown in FIGS. 4 and 5, similar parts are similarly designated, but with primes. In this construction, an opening 8*b'* is covered by a lid 13' which is biased by a spring 17 into a closed position, as shown in FIG. 5. In this arrangement, the cartridge transport means includes a stopping mechanism 18 for preventing an irregular position of the cartridges during the loading operation, as shown in FIG. 4. This back drop stopping mechanism 18 permits easy communication between the cartridges being loaded and the annular storage space 10', as shown in FIG. 4, and it also permits proper orientation of feeding of the cartridges to the cartridge chamber. In the embodiment of FIGS. 4 and 5, the chute or connecting passage can be omitted.

As soon as the first loading operation, according to FIG. 4, is terminated, and the supply clip 14' is removed, opening 8*b* closes again and the first cartridge 20 is pushed by spring 16 of supply receptacle 10 into a second feeding star 19. By manually actuating the breech (not shown) twice, the second feeding star 19 which is coupled to the breech is turned through two divisions so that the first cartridge 20 is displaced into alignment with the cartridge chamber 12' which, in turn, is aligned with the barrel.

While specific embodiments of the invention have been shown and described in detail to illustrate the application of the principles of the invention, it will be understood that the invention may be embodied otherwise without departing from such principles.

What is claimed is:

1. A firearm, comprising a housing, a barrel mounted on said housing having a cartridge chamber, a magazine having a cartridge receptacle portion and formed in said housing and having a passage for cartridges extending between said receptacle portion and said cartridge chamber, said receptacle portion being a drum-like member rotatable in said housing and constructed to contain a plurality of cartridges therein in parallel relationship to said barrel, cartridge transport means in said magazine receptacle portion engageable with the cartridge therein to move said cartridges successively into alignment with said cartridge chamber, and a cartridge clip loading opening defined in said magazine housing communicating with said cartridge receptacle portion and having means thereon for positioning a cartridge loading container for transferring cartridges therefrom into said magazine receptacle portion and into association with said cartridge transport means, said cartridge receptacle portion including said drum-like member and a tangentially extending portion forming said passage, said tangentially extending portion being shiftable upon rotation of said drum-like portion between a position in which the upper end thereof is aligned with said cartridge chamber and a position in which the upper end thereof is aligned with the loading opening.

2. A firearm according to claim 1, wherein said opening is defined in the side of said housing spaced from the cartridge chamber, said tangentially extending portion of said receptacle comprising a chute which extends obliquely through said magazine housing in a loading position in which the upper end thereof is aligned with the opening, and a cover pivotally mounted on said housing for opening and closing the opening.

3. A firearm according to claim 2, including an openable container of ammunition which is positionable over the mounting opening and which is deformable to load the cartridges therefrom into the magazine receptacle portion.

4. A firearm according to claim 1, including a cover for closing the loading opening, spring means biasing said cover into a closed position, said magazine receptacle portion being located directly adjacent the opening in a position to receive cartridges therethrough and in a position to pass cartridges through said passage to said cartridge chamber.

5. A firearm according to claim 4, wherein said cartridge transport means comprises a rotatable member, a torsion spring connected to said member, said cartridges being insertable into said receptacle portion to engage with said rotatable cartridge transport means and to tension said spring during insertion of said cartridges.

6. A firearm magazine, comprising an outer magazine housing, a drum-like rotatable receptacle in said housing, said housing having a top portion alignable with a firearm cartridge chamber, and having a side portion with a loading opening therein, a tangentially extending part connected to said drum-like receptacle and forming a tangentially extending connecting passage selectively positionable tangentially between said drum-like receptacle and the cartridge chamber and tangentially between said drum-like receptacle and said leading opening, said drum-like receptacle being rotatable to position the tangentially extending portion selectively into alignment with the cartridge chamber and with the opening.

7. A magazine according to claim 6, including a rotatable star member in said receptacle portion, a spring connected to said rotatable star and being tensioned by rotation thereof during insertion of cartridges into said receptacle portion.

8. A magazine according to claim 6, wherein said tangentially extending portion comprises part of said drum-like structure and extends tangentially outwardly therefrom.

9. A magazine according to claim 6, wherein said tangentially extending portion comprises a passage defined in said housing extending to said opening, said housing having a second chamber portion for receiving cartridges and transferring them into alignment with said cartridge chamber.

* * * * *